US005711530A

United States Patent [19]

Lewis

[11] Patent Number: 5,711,530

[45] Date of Patent: Jan. 27, 1998

[54] VEND EVERY TIME SKILL CRANE

[76] Inventor: Michael W. Lewis, 28132 Via Rueda, San Juan Capistrano, Calif. 92675

[21] Appl. No.: 741,403

[22] Filed: Oct. 29, 1996

[51] Int. Cl.[6] ..... A63F 9/00

[52] U.S. Cl. ..... 273/448

[58] Field of Search ..... 273/448, 447, 273/440, 454; 221/210, 211

[56] References Cited

U.S. PATENT DOCUMENTS

| | | | |
|---|---|---|---|
| 4,718,667 | 1/1988 | Shoemaker, Jr. | 273/448 |
| 5,271,628 | 12/1993 | Okada | 221/210 |
| 5,397,134 | 3/1995 | Fishman et al. | 221/210 |
| 5,415,417 | 5/1995 | Reis, Jr. | 273/447 |
| 5,511,794 | 4/1996 | Katamoto | 273/454 X |
| 5,549,372 | 8/1996 | Lewis | 273/448 X |

FOREIGN PATENT DOCUMENTS

| | | | |
|---|---|---|---|
| 406319869 | 11/1994 | Japan | 273/448 |
| 2214909 | 9/1989 | United Kingdom | 273/448 |

*Primary Examiner*—Paul E. Shapiro
*Attorney, Agent, or Firm*—Brady, O'Boyle & Gates

[57] ABSTRACT

A vend every time skill crane wherein a vendable prize, such as a capsule containing an item, is dispensed every time money is inserted into the machine while the claw and associated manipulator are simultaneously energized for an allotted play opportunity to allow a player to attempt to grasp and retrieve a prize, such as a stuffed toy animal or other items.

6 Claims, 4 Drawing Sheets

VEND EVERY TIME SKILL CRANE

BACKGROUND OF THE INVENTION

Skill cranes have been in use for many years wherein a plurality of various prizes, such as stuffed toy animals, are contained within a cabinet having a claw mechanism contained therein, and activated by a person outside the cabinet, whereby an attempt is made to grasp and retrieve one of the prizes from the cabinet within a predetermined period of time. A money actuated mechanism completes the electrical circuit for energizing the claw mechanism manipulated by the person by means of a control knob or joy stick, and the timer which opens the circuit to stop the actuation of the claw mechanism. Oftentimes, the predetermined period of time expires before the person has had a chance to retrieve a prize; thus, requiring additional money to be inserted into the mechanism for continued play.

Without the assurance of receiving any prize, no matter how many times the skill crane is played, many persons become discouraged and do not return to play again.

In order to encourage people to play the skill crane, it has been proposed in U.S. Pat. No. 5,397,134 dated Mar. 14, 1995 to provide a "winner—every time" skill crane wherein the player or operator can continue to play, without any time limit, until a prize has been retrieved and dropped into a discharge chute. The presence of the prize in the chute is sensed to thereby stop the crane.

While this skill crane is satisfactory for encouraging persons to play, there is a disadvantage, in that one person can monopolize a skill crane for a long period of time, which is not economical for the owner of the skill crane. Since it usually costs 50 cents to play the crane, if one person plays the crane for one hour, the owner will not earn as much as could be earned if the crane was available for playing by ten people an hour.

To overcome the disadvantage inherent in the "winner-every time" type skill crane, the "vend every time" skill crane of the present invention has been devised which has the advantage of dispensing a vendable prize every time the money accepting (coin or bill) mechanism is actuated while still maintaining the predetermined time for the customer to exercise play options for additional prizes in the large prize bin.

SUMMARY OF THE INVENTION

The vend every time skill crane of the present invention comprises, essentially, a cabinet having a first hopper containing prizes, such as stuffed toy animals or other items, and a second hopper containing other prizes, such as capsules containing other vended items, such as a ball, novelty, stickers, small plush toy, and the like. Both hoppers communicate with a discharge chute, and the second hopper contains a discharge assistant which is actuated every time the skill crane money accepting mechanisms are actuated, whereby a vended prize is dispensed from the second hopper into the discharge chute where it can be retrieved by the customer playing the crane. Simultaneously, with the actuation of the money accepting mechanism, the timer and claw mechanism are energized, and the customer is allotted a predetermined period of time to exercise a play option to attempt to retrieve a prize from the first hopper—much like a conventional skill crane.

By the construction and arrangement of the skill crane of the present invention, the customer playing the skill crane receives a prize every time the money accepting mechanism is actuated and, thus, likely to keep exercising play options until a prize from the first hopper is obtained. The owner of the skill crane also benefits since the skill crane cannot be monopolized for a long period of time without inserting money into the machine.

DESCRIPTION OF THE PREFERRED EMBODIMENTS

Figure 1:
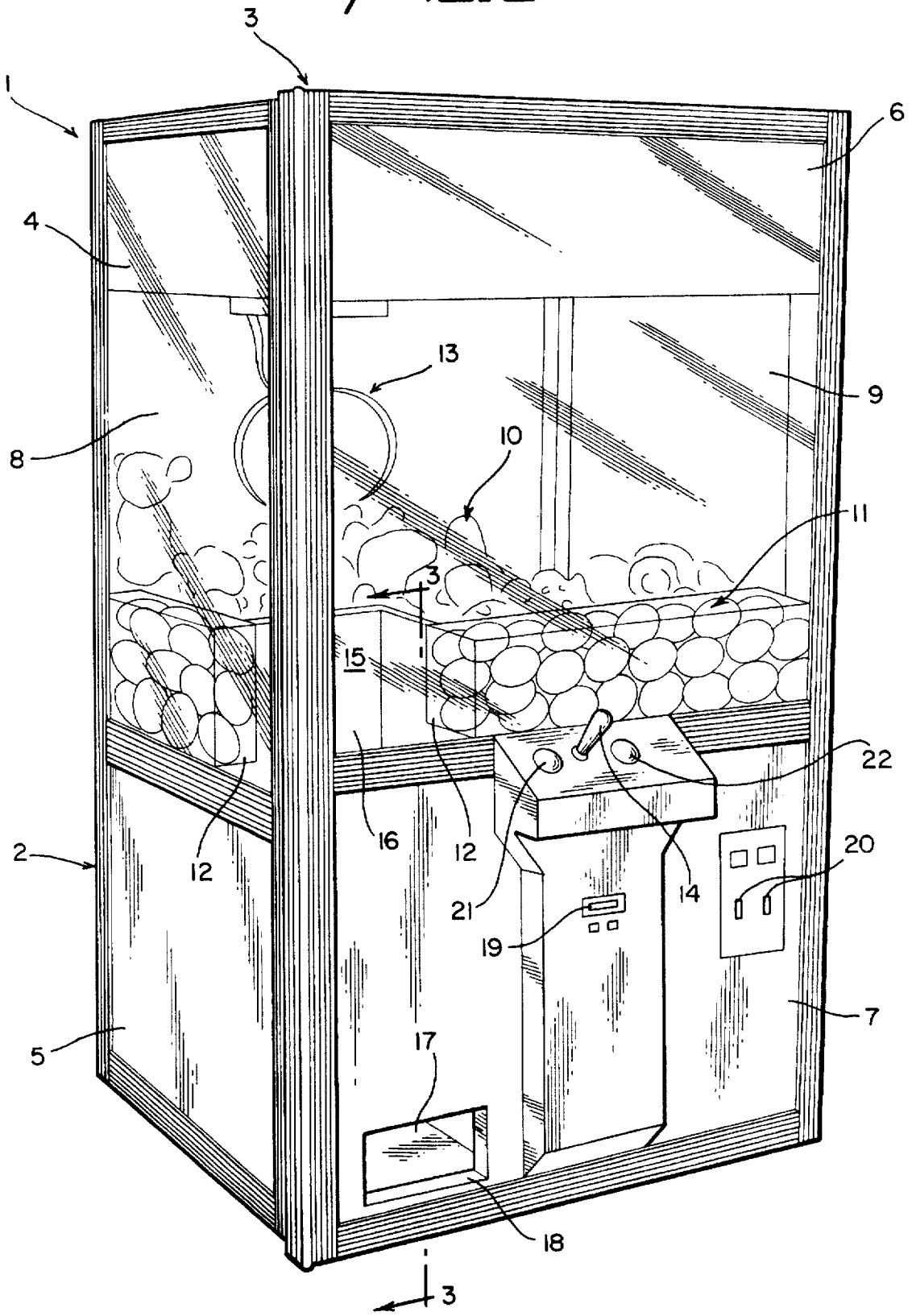
FIG. 1 is a perspective view of the vend every time skill crane of the present invention.

Referring to the drawings and, more particularly to FIG. 1, the vend every time skill crane 1 of the present invention comprises a cabinet 2 of the type disclosed in pending application Ser. No. 08/402,012 filed Mar. 10, 1995 now U.S. Pat. No. 5,549,372 dated Aug. 27, 1996 including an extruded aluminum frame assembly 3 having opaque decorative panels 4, 5, 6, and 7, selectively mounted therein, together with transparent glass panels 8 and 9.

The cabinet 2 contains a plurality of prizes 10, such as stuffed toy animals; and a plurality of vended prizes 11, such as capsules containing vendable items, displayed in transparent containers 12 mounted in the cabinet 1. The prizes 10 are adapted to be grasped by a claw assembly 13 operated by a customer using a joystick 14 mounted on the front of the cabinet 2. A plexiglass partition 15 is mounted in the cabinet 2 to provide a chamber 16 within the cabinet communicating with a chute 17 having an opening 18 in the front of the cabinet, whereby a prize 10 grasped by the claw assembly 13 is deposited in the chute 17 and retrieved therefrom by the customer operating the crane.

The front of the cabinet 2 also includes a bill receiving mechanism 19 and coin receiving mechanism 20. Lights 21 and 22 are also provided adjacent the joystick 14 to advise the customer of the start and expiration of the allowed play opportunity for grasping a prize 10.

Figure 2:
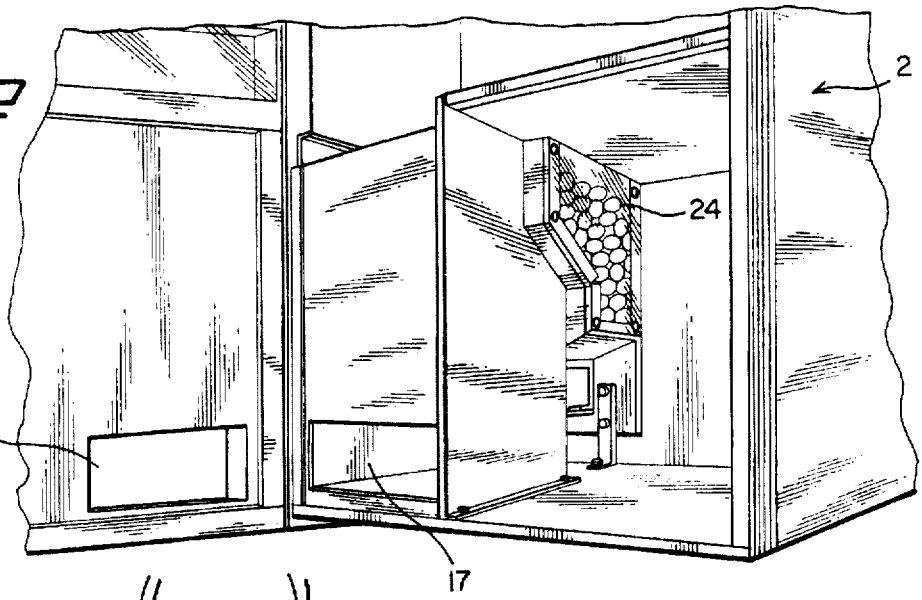
FIG. 2 is a fragmentary perspective view of the skill crane shown in FIG. 1 with the front door open showing the storage hopper for the vended prizes.
Figure 3:
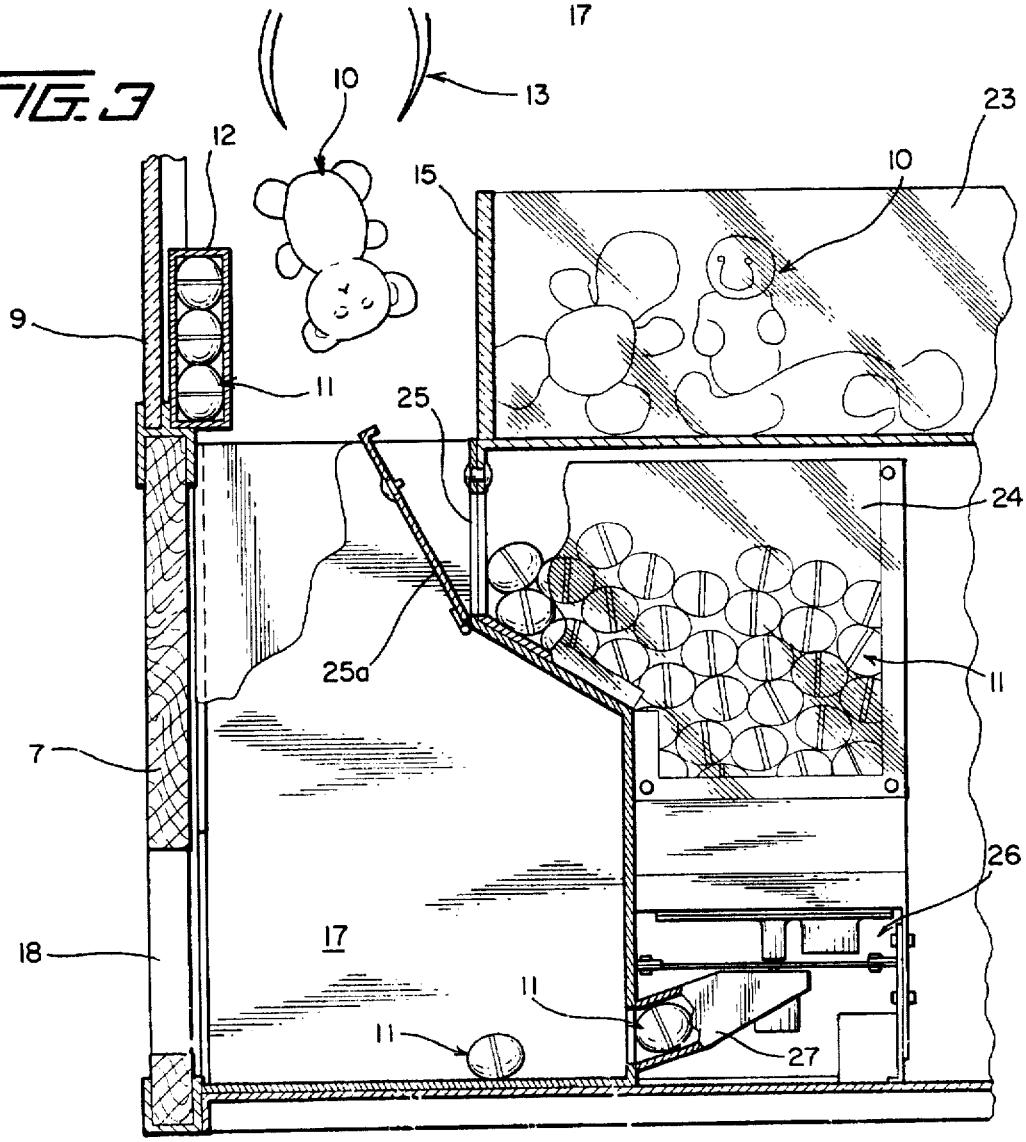
FIG. 3 is an fragmentary, sectional, side elevational view taken along 3—3 of FIG. 1.
Figure 4:
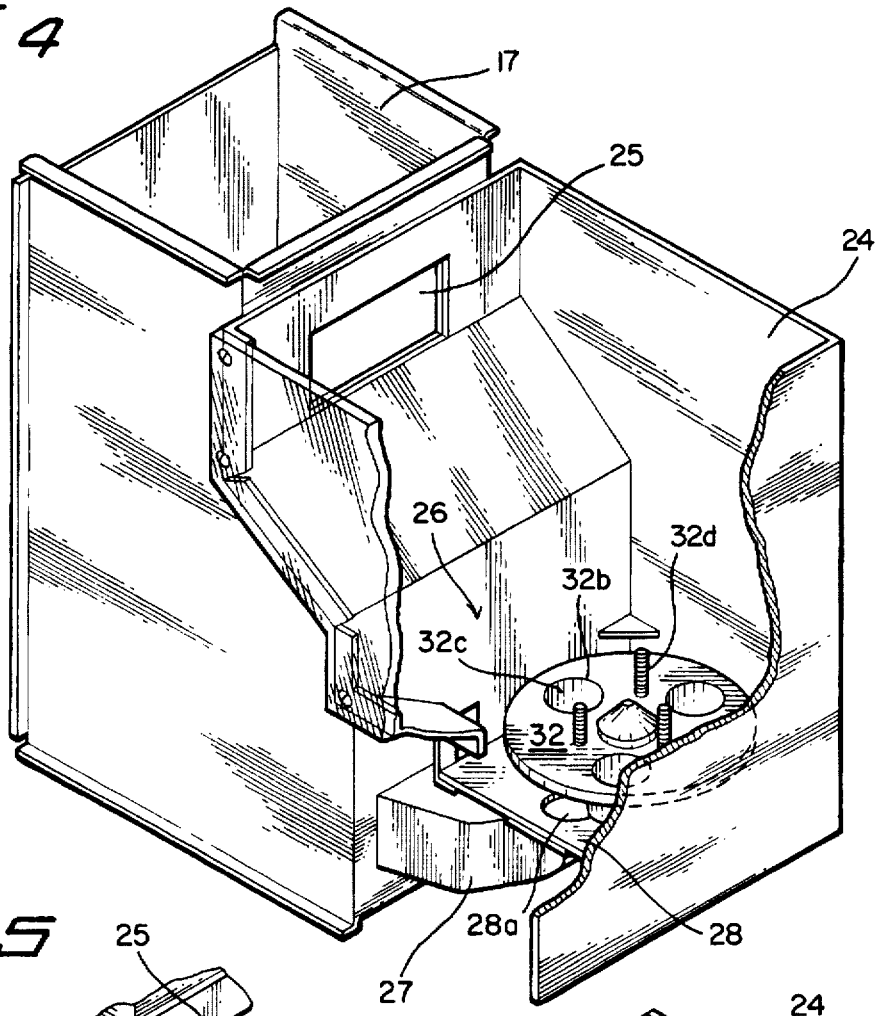
FIG. 4 is a fragmentary, sectional, perspective view of the vended prize storage hopper and discharge assistant.
Figure 5:
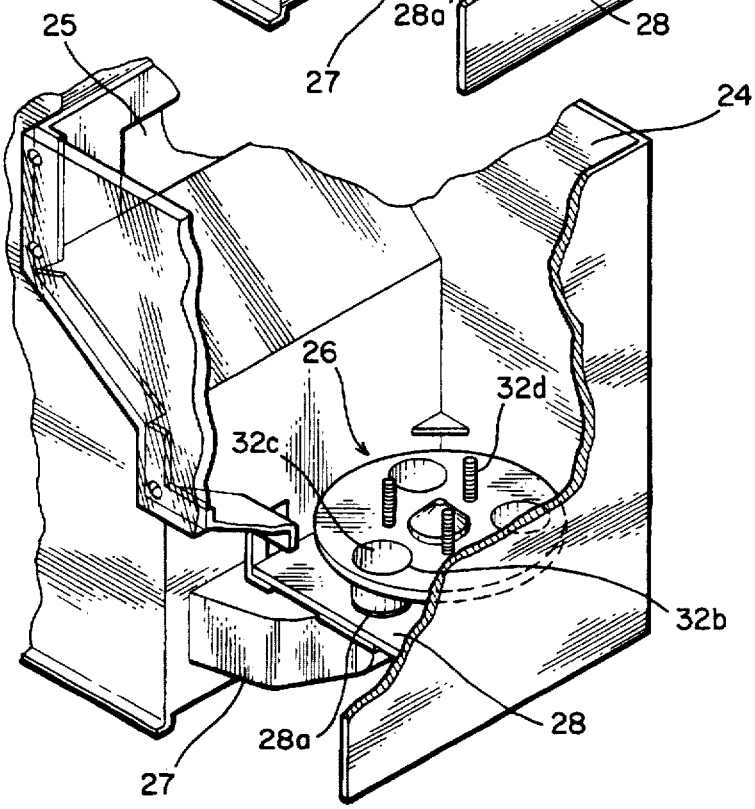
FIG. 5 is a view similar to FIG. 4 showing the discharge assistant in the position for dispensing a vended prize from the hopper.
Figure 6:
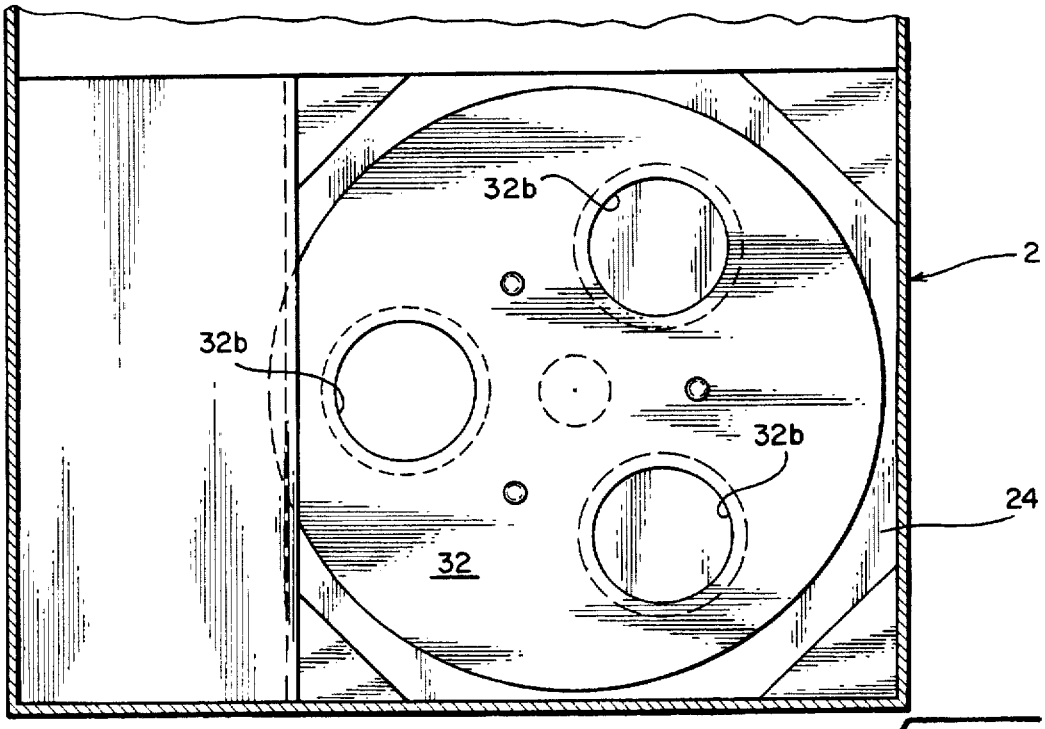
FIG. 6 is a fragmentary, sectional top plan view of the discharge assistant shown in FIG. 5.
Figure 7:
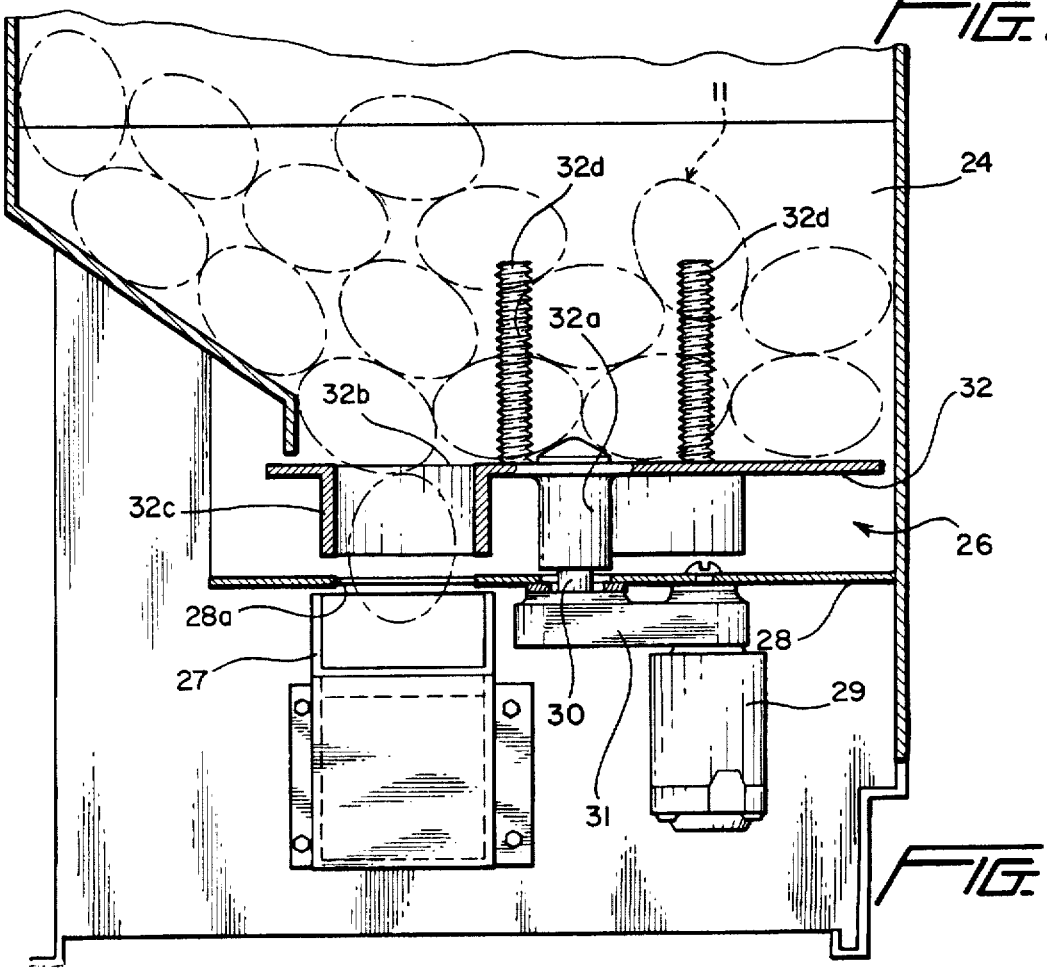
FIG. 7 is a fragmentary, sectional side elevational view of the discharge assistant shown in FIG. 5.

As will be seen in FIGS. 2 and 3, the interior of the cabinet 2 contains a first, hopper 23 containing the plurality of stuffed toy animals 10, and a second hopper 24 holding the plurality of capsules containing vendable items 11. The second hopper 24 is provided with an opening 25 having a door 25*a*, shown in the open position, through which the plurality of capsules 11 are supplied to the hopper. The lower end of the second hopper 24 communicates with a discharge assistant 26 which, in turn, communicates with a discharge chute 27 communicating with the cabinet chute 17.

The details of the construction of the discharge assistant 26 are illustrated in FIGS. 4 to 7 and comprises a floor 28 mounted within the cabinet and having an aperture 28*a* provided therein aligned with the inlet of chute 27. An electric motor 29 is fastened to the lower surface of the floor 28 and is connected to a rotary shaft 30 by a suitable reduction gear assembly 31. A disc 32 having a hub 32*a* fastened to the shaft 30 is positioned at the lower end of the second hopper 24 and is rotatable therein. A plurality of openings 32*b* having depending sleeves 32*c* are provided in the disc 32, whereby as the disc 32 is rotated, the openings 32*b* and associated sleeves 32*c* become aligned with the aperture 28*a* in the floor 28, to thereby allow a capsule 11 to fall from the hopper 24 and be guided by the sleeve 32*c* into the cabinet chute 27. The rotatable disc 32 is also provided with a plurality of vertically extending pins or rods 32*d* which agitate the supply of capsules 11 in the hopper 24 during the rotation of the disc 32; to thereby prevent the capsules from becoming compacted while stored in the hopper 24.

In the operation of the vend every time skill crane of the present invention, a customer or player inserts money into either the bill mechanism 19 or coin mechanism 20 to close an electrical circuit, and the discharge assistant 26 is actuated to rotate the disc 32 for dispensing a capsule 11, or capsules, depending upon the amount of money inserted, from the second hopper 24 into the cabinet chute 17. The claw assembly 13 and associated joystick 14 are also energized for a set period of play opportunity so that the customer can attempt to grasp and retrieve a prize 10 from the first hopper 23 and deposit it into the cabinet chute 17. The customer can retrieve the capsule(s) 11 from the cabinet chute 17, and any prizes retrieved from the first hopper utilizing play opportunities.

It will be understood by those skilled in the art that the number of capsules dispensed from the second hopper 24 and the play opportunities for the skill crane will depend on the amount of money inserted into the bill receiving mechanism 19 or coin receiving mechanism 20. For instance, if each game costs 50 cents and the player inserts a five dollar bill into the bill receiving mechanism 19, ten capsules 11 will be immediately dispensed into the cabinet chute 17, and the player will be allotted ten play opportunities.

From the above description, it will be readily apparent that the vend every time skill crane is an improvement over the "winner-every time" type skill cranes, in that the player can only monopolize the skill crane for a time proportional to the amount of money inserted into the machine, while at the same time receiving a number of prizes and play opportunities depending upon the amount of money inserted into the machine.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A vend every time skill crane comprising a cabinet having a front wall, a first hopper in said cabinet, a plurality of prizes contained in said first hopper, a second hopper in said cabinet, a plurality of vendable prizes contained in said second hopper, an opening in said front wall of said cabinet, an outlet chute in said cabinet communicating said opening with said first and second hoppers, a claw assembly mounted in said cabinet for grasping a main prize from said first hopper, a manipulator on the front wall of said cabinet operatively connected to said claw assembly, a discharge assistant positioned below the second hopper and adapted to dispense said vendable prizes from the second hopper into the cabinet chute, and money receiving mechanisms in the front wall of said cabinet, said mechanisms being adapted to be operatively connected to an electrical circuit for energizing the claw mechanism and the discharge assistant, whereby each time money is inserted into the mechanisms a vendable prize is dispensed from the second hopper and the manipulation and claw mechanism are energized for play opportunities from the first hopper within a predetermined time.

2. A skill crane according to claim 1, wherein the discharge assistant comprises a bottom wall at the lower end of the second hopper, an aperture in said bottom wall communicating with the cabinet chute, a rotary disc positioned above said bottom wall, a motor operatively connected to said disc for rotating said disc, at least one opening in said disc adapted to communicate with the aperture in said bottom wall, the plurality of vendable prizes being supported on the top surface of said rotary disc, whereby during the rotation of said disc a vendable prize is dispensed from the second hopper into the cabinet chute when the opening in the disc becomes aligned with the aperture in the bottom wall.

3. A skill crane according to claim 2, wherein a sleeve depends from the opening in said disc for guiding a vendable prize from said second hopper through said aperture in the bottom wall.

4. A skill crane according to claim 2, wherein a plurality of vertically extending rods are mounted on the upper surface of said disc for agitating the vendable prizes in the second hopper during rotation of said disc to thereby prevent compaction of said vendable prizes in said second hopper.

5. A skill crane according to claim 1, wherein said prizes comprise a plurality of said first hopper items, such as stuffed toys.

6. A skill crane according to claim 1, wherein said vendable prizes comprise a plurality of capsules containing an item, such as a ball, novelty, stickers, or small plush toy.

* * * * *